US008433230B2

(12) United States Patent
Seto et al.

(10) Patent No.: US 8,433,230 B2
(45) Date of Patent: Apr. 30, 2013

(54) IMAGE FORMING APPARATUS

(75) Inventors: Takashi Seto, Kanagawa (JP); Takeshi Yamamoto, Kanagawa (JP); Kenichi Hasegawa, Kanagawa (JP); Fumihiro Hirose, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 317 days.

(21) Appl. No.: 12/986,425

(22) Filed: Jan. 7, 2011

(65) Prior Publication Data

US 2011/0206425 A1 Aug. 25, 2011

(30) Foreign Application Priority Data

Feb. 25, 2010 (JP) ..... 2010-040102

(51) Int. Cl.
*G03G 15/20* (2006.01)

(52) U.S. Cl.
USPC ..... 399/323

(58) Field of Classification Search ..... 399/91–93, 399/122, 320–323; 271/312
See application file for complete search history.

(56) References Cited

U.S. PATENT DOCUMENTS

| | | | | |
|---|---|---|---|---|
| 3,955,813 | A | 5/1976 | Edwards | |
| 7,747,205 | B2 * | 6/2010 | Fujii | 399/323 |
| 8,162,315 | B2 * | 4/2012 | Baba | 271/312 |
| 2009/0003897 | A1 | 1/2009 | Yamada | |
| 2009/0274492 | A1 * | 11/2009 | Ishikawa | 399/323 |

FOREIGN PATENT DOCUMENTS

| | | |
|---|---|---|
| JP | 57-46794 | 10/1982 |
| JP | 3-32878 | 2/1991 |
| JP | 11-334191 | 12/1999 |
| JP | 2007-187715 | 7/2007 |
| JP | 2007-240920 | 9/2007 |
| JP | 2008-102408 | 5/2008 |
| JP | 2009-31759 | 2/2009 |

OTHER PUBLICATIONS

U.S. Appl. No. 12/959,705, filed Dec. 3, 2010, Hasegawa,et al.
U.S. Appl. No. 12/986,425, filed Jan.7, 2011, Seto, et al.

* cited by examiner

*Primary Examiner* — Hoan Tran
(74) *Attorney, Agent, or Firm* — Oblon, Spivak, McClelland, Maier & Neustadt, L.L.P.

(57) ABSTRACT

A disclosed image forming apparatus includes an image carrier; a developing device configured to form a toner image on the image carrier; a compressed air generating unit configured to generate compressed air; an air nozzle configured to eject the compressed air; a fixing device configured to fix the toner image on a sheet, the sheet being separated from the fixing device by the compressed air ejected from the air nozzle to the sheet; a pressure regulation unit provided between the compressed air generating unit and the air nozzle; and a guide path connected to the pressure regulation unit and configured to guide excess air generated by a pressure regulation of the pressure regulation unit to at least one part in the image forming apparatus.

9 Claims, 5 Drawing Sheets

IMAGE FORMING APPARATUS

BACKGROUND OF THE INVENTION

1. Field of the Invention

The present invention generally relates to an image forming apparatus such as an electrophotographic printer, facsimile, and copier.

2. Description of the Related Art

Conventionally, as a device for fixing an unfixed toner image transferred on a sheet such as paper in these image forming apparatuses, a heat roller fixing device has been known and widely used. In the heat roller fixing device, while the sheet having the unfixed toner image is sandwiched and conveyed, the sheet is heated and pressurized by a fixing nip part formed of a fixing roller incorporating a halogen heater and the like and a pressure roller that pressurizes the fixing roller, so that the toner image is fixed.

Moreover, a belt fixing device has also been known. In the belt fixing device, an endless fixing belt is stretched by a heating roller incorporating a halogen heater and the like and a fixing roller, and a fixing nip part formed of the fixing belt and a pressure roller that pressurizes the fixing roller interposing the fixing belt heats and pressurizes the sheet having the unfixed toner image while sandwiching and conveying the sheet, so that the toner image is fixed.

By these fixing methods, a toner image fused on a sheet contacts a fixing member such as the fixing roller and fixing belt. Therefore, surfaces of these fixing members are coated with a fluororesin having superior releasability, and a separation claw for separating the sheet from the fixing member is used. When using the separation claw, however, a claw mark or claw scar is easily formed on the surface of the fixing member because the separation claw contacts the fixing member. As a result, there is a problem in that a striation is generated on an output image.

In the case of a monochrome image forming apparatus, in general, a fixing roller is formed of a metal roller whose surface is coated with Teflon (registered trademark). Therefore, a scar is not easily formed on the fixing roller even when contacted by the separation claw. Accordingly, the fixing roller has a long life. In the case of a color image forming apparatus, however, a surface layer of a fixing roller is formed by coating a silicone rubber with fluorine in order to improve color development (generally, about several tens of microns of PFA (Tetra fluoro ethylene perfluoro alkyl vinyl ether copolymer) tube is used). Alternatively, the surface layer of the fixing roller is formed by applying oil to a silicone rubber. The surface layer with such a structure is soft and vulnerable.

When the surface layer gets a scar, a scar like a striation appears on a fixed image. Therefore, in many color image forming apparatuses today, a non-contact separation unit is used instead of using a contact unit such as the separation claw that contacts the fixing member, to separate a sheet from the fixing member without contact. In the separation without contact, a sheet on which toner is fixed is easily wound around a fixing member when an adhesion force between the toner and fixing member is high. In this case, a winding jam occurs, in which a sheet passes through a gap while tightly contacting the fixing member. In the color image forming apparatus, in particular, plural toner layers are stacked on a sheet. Therefore, a winding jam easily occurs due to an adhesion force increased by the stacked toner layers. In particular, a sheet having a small blank space at a leading end part, on which no toner is attached; and a sheet on which a solid image such as a photograph is formed easily cause the winding jam due to their adhesion forces.

At present, the following sheet separating methods are used for separating sheets in the color image forming apparatus.

(1) A non-contact separation plate method, in which a separation plate extending in parallel with a longitudinal direction and a width direction of a fixing roller and a fixing belt is provided so that a fine gap (about 0.2 mm to 1.0 mm) is formed between the fixing roller and fixing belt.

(2) A non-contact separation claw method, in which separation claws are arranged at a predetermined interval in a longitudinal direction of a fixing roller and a fixing belt so that a fine gap (about 0.2 mm to 1.0 mm) is formed between the fixing roller and fixing belt.

(3) A self-stripping method, by which a sheet is naturally peeled off due to an elasticity of the sheet and an elasticity of curved parts of a fixing roller and a fixing belt.

In any of these methods, however, there is a gap between the separation plate or separation claws and the fixing roller and fixing belt. Thus, when passing a thin sheet, a sheet having a small blank space at a leading end, or a solid image such as a photograph, the sheet passes through the gap while the sheet is tightly contacting the fixing roller or fixing belt. Therefore, a winding jam of the sheet occurs, or a jam is caused by the sheet hitting the separation plate or separation claw.

In view of the above-mentioned, there has been suggested and used a unit for blowing air onto a sheet at a sheet separation position to separate the sheet from the fixing roller and fixing belt, in order to reinforce the non-contact separation unit. In this manner, in an image forming apparatus provided with a non-contact separation unit that separates a sheet by blowing compressed air from an air nozzle to the sheet at a sheet separation position without damaging a fixing member such as a fixing roller and a fixing belt, a compressed air generating unit (hereinafter arbitrarily referred to as a compressor) and a pneumatic piping extending from the compressor to the air nozzle for controlling and circulating the compressed air are provided.

Each of six to ten air nozzles provided in the image forming apparatus has a cross sectional area with a diameter $\phi$=1 mm or less. The air nozzles blow air for about 100 msec at a moment when a leading end of a sheet leaves a fixing nip part. Thus, a flow volume of the compressed air is small. Accordingly, the pneumatic piping is constituted by arranging a tank with an appropriate capacity (for example, about 1 liter) for accumulating the compressed air and the like, a small compressor, and a relief valve. This constitution is preferable because a structure is compact, and there are few pressure variations at the time of ejecting air. With this constitution, however, excess air has always been discharged from the relief valve while the compressor is operating, and wasted without being used. Further, since a noise generated when the excess air is discharged is noisy, a silencer is required to be provided at a discharge outlet for noise control, which has been a factor to increase the cost.

In Patent Document 1, in order to prevent a decrease of a temperature at a surface of a fixing member caused by air blown onto the fixing member by a residual pressure in an air pipe line facing the fixing member even after a sheet is separated from the fixing member by an air blow, an additional air pipe line that deviates the fixing member is provided. By letting the residual pressure out from this air pipe line, an air blow onto the fixing member caused by the residual pressure is reduced. However, piping of the additional air pipe line and utilization of air are not described in detail in Patent Document 1.

[Patent Document 1]
Japanese Patent Application Publication No. 2008-102408

SUMMARY OF THE INVENTION

In view of the above-mentioned problems, it is an object of at least one embodiment of the invention, in an image forming apparatus having a pneumatic piping provided with a relief valve, to effectively use excess air discharged from the relief valve, and to achieve long lives of a photosensitive body and its peripheral members, stabilization of a motion of a sheet, higher efficiency of controlling a fixing temperature of a sheet, and reduction of waiting time for cooling a fixing member.

According to one aspect of the present invention, an image forming apparatus includes an image carrier; a developing device configured to form a toner image on the image carrier; a compressed air generating unit configured to generate compressed air; an air nozzle configured to eject the compressed air; a fixing device configured to fix the toner image on a sheet, the sheet being separated from the fixing device by the compressed air ejected from the air nozzle to the sheet; a pressure regulation unit provided between the compressed air generating unit and the air nozzle; and a guide path connected to the pressure regulation unit and configured to guide excess air generated by a pressure regulation of the pressure regulation unit to at least one part in the image forming apparatus.

DETAILED DESCRIPTION OF THE PREFERRED EMBODIMENTS

First, an embodiment of an image forming apparatus concerning the present invention is described.

Figure 1:
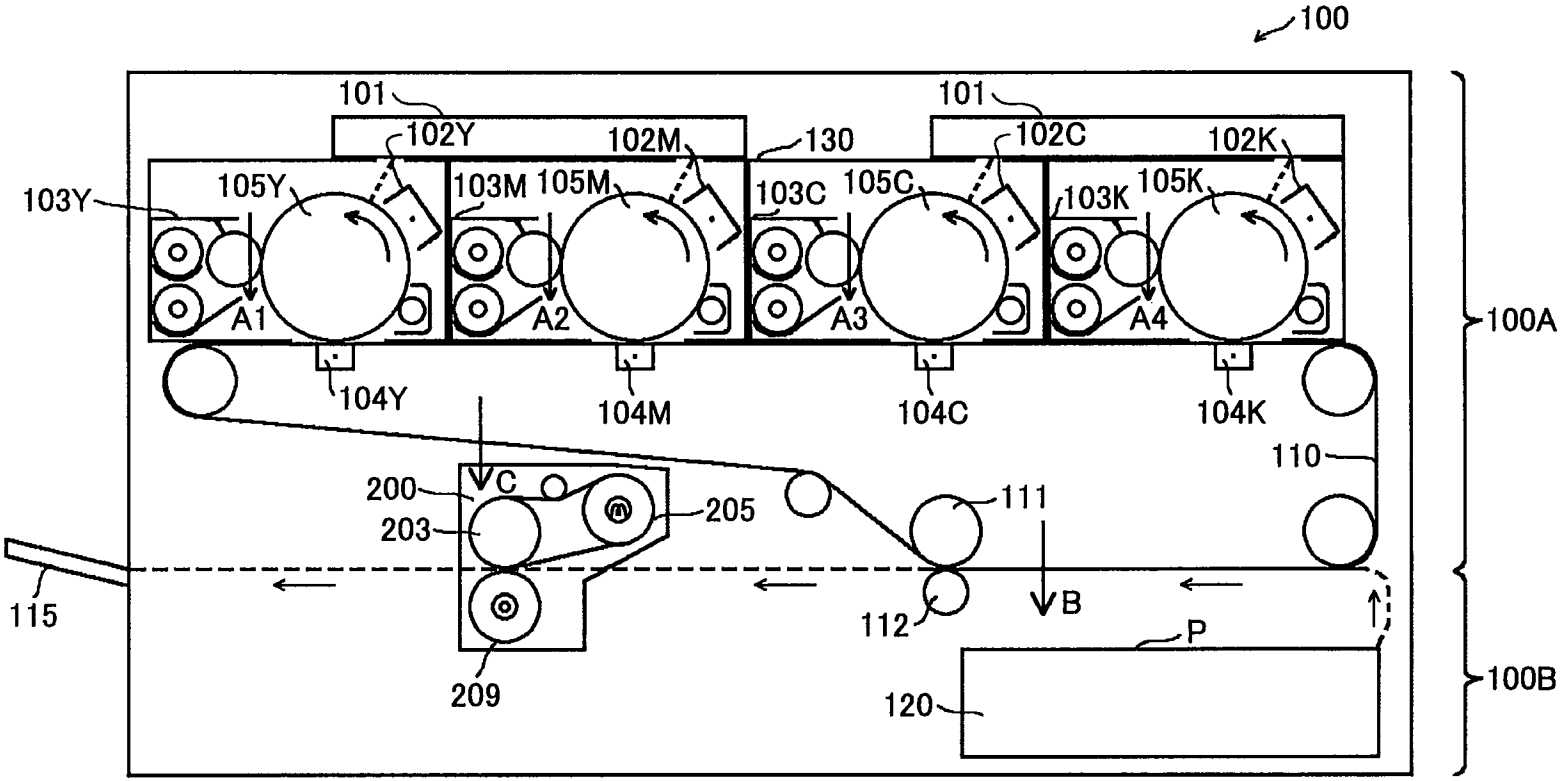
FIG. 1 is a diagram showing a configuration of a main part of a tandem type color copier that is an image forming apparatus concerning the present invention.

FIG. 1 shows a configuration of a main part of a tandem type color copier that is an image forming apparatus concerning the present invention. A color copier 100 is a high speed image forming apparatus including an image forming part 100A positioned at a central part of an apparatus body, a sheet feeding part 100B positioned below the image forming part 100A, and an image reading part (not shown) positioned over the image forming part 100A. A fixing device 200 is incorporated in the image forming part 100A.

In the image forming part 100A, an intermediate transfer belt 110 having a horizontally extending transfer surface is provided. An upper surface of the intermediate transfer belt 110 is provided with a structure for forming an image of colors that are in a complementary color relationship with color separation colors. That is, photosensitive bodies 105Y, 105M, 105C, and 105K serving as image carriers that carry images of toners of the colors (yellow, magenta, cyan, and black) that are in the complementary color relationship are arranged along the transfer surface of the intermediate transfer belt 110.

Each of the photosensitive bodies 105Y, 105M, 105C, and 105K is formed of a drum that is rotatable in the same directions (counterclockwise). In the peripheries of the photosensitive bodies, optical writing devices 101 that perform an image forming process in the rotation process; charging devices 102Y, 102M, 102C, and 102K; developing devices 103Y, 103M, 103C, and 103K; primary transfer devices 104Y, 104M, 104C, and 104K; and a cleaning device are arranged. The developing devices 103Y, 103M, 103C, and 103K house respective color toners. The photosensitive bodies 105, charging devices 102, developing devices 103, and the like form imaging units.

The intermediate transfer belt 110 is wrapped around driving rollers and driven rollers, so as to be movable in the same direction as the photosensitive bodies 105Y, 105M, 105C, and 105K at positions facing the photosensitive bodies. Further, a transfer roller 112 is provided at a position facing a roller 111 that serves as one of the driven rollers. A conveyance path of the sheet P from the transfer roller 112 to the fixing device 200 is a transverse path.

The sheet feeding part 100B includes a sheet feed tray 120 in which sheets P as recording media are stacked and housed, and a conveying mechanism that separates the sheets P in the sheet feed tray 120 one by one sequentially from a top sheet and conveys the separated sheet to a position of the transfer roller 112.

As to an image forming operation by the image forming apparatus 100, a surface of the photosensitive body 105Y is uniformly charged by the charging device 102Y, and an electrostatic latent image is formed on the photosensitive body 105Y on the basis of image information obtained from the image reading part. The electrostatic latent image is visualized as a toner image by the developing device 103Y housing a yellow toner. The toner image is primarily transferred onto the intermediate transfer belt 110 by a primary transfer device 104Y to which a predetermined bias is applied. A similar image formation is performed on other photosensitive bodies 105M, 105C, and 105K except that the colors of toners are different. Toner images of the respective colors are sequentially transferred and overlapped on the intermediate transfer belt 110 by an electrostatic force.

Subsequently, the toner image that was primarily transferred from the photosensitive bodies 105Y, 105M, 105C, and 105K onto the intermediate transfer belt 110 is transferred on the sheet P conveyed to between the roller 111 and transfer roller 112. The sheet P on which the toner image is transferred is further conveyed to the fixing device 200, whereby the toner image is fixed at a fixing nip part formed by a fixing belt 207 and a pressure roller 209, as described below. On an outlet side, from which the sheet P exits, of the fixing nip part, an air nozzle 215 is provided on the fixing belt 207 side. By an air ejection from the air nozzle, the sheet P is discharged from the exit of the fixing nip part without being wound around the fixing belt 207 or pressure roller 209.

Next, the sheet P discharged from the fixing nip part is sent along a discharge path to a stacker 115 that serves as a sheet discharge part.

According to the present invention, as described above, a higher fixation and separating function can be obtained by the image forming apparatus including the fixing device 200 having the air nozzle 215, and the image forming apparatus can accept various kinds of sheets and images.

Figure 2:
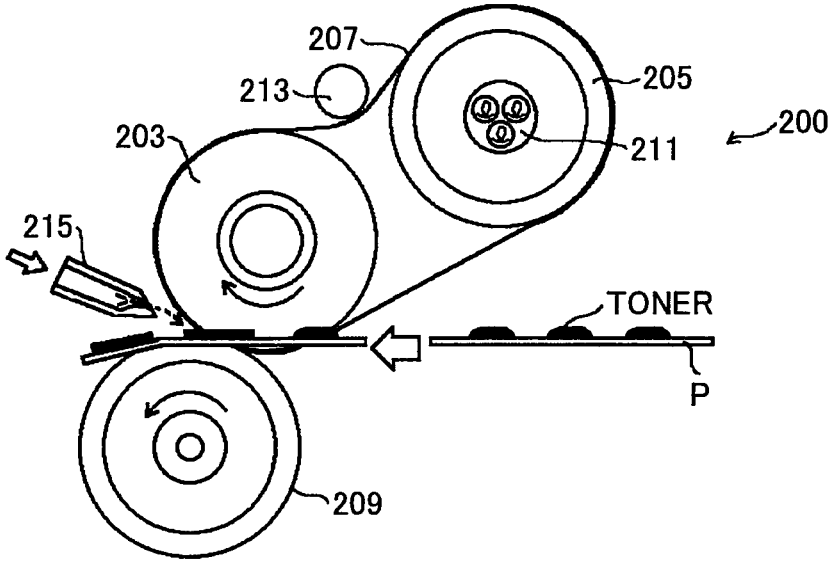
FIG. 2 is a cross-sectional view of a fixing device formed of a belt fixing device according to the present invention.

FIG. 2 is a cross-sectional view of the fixing device 200 formed of a belt fixing device according to the present invention. In this belt fixing device 200, the fixing belt 207 serving as a fixing member is supported and stretched by a fixing roller 203 serving as a driving roller connected to a driving source (not shown) and a heating roller 205 serving as a driven roller, and rotates and runs clockwise.

The pressure roller 209 is provided facing the fixing roller 203 with the fixing belt 207 interposed therebetween. The pressure roller 209 is pressurized by a pressurizing mechanism (not shown) to the fixing roller 203 with the fixing belt 207 interposed therebetween. A fixing heater 211 serving as a heat source is provided inside the heating roller 205. The heating roller 205 is heated by the fixing heater 211. Therefore, the fixing belt 207 is also heated by the heating roller 205. The fixing belt 207 is rotated by rotation driving of the fixing roller 203 serving as a driving roller. At the same time, the pressure roller 209 is rotated following the fixing belt 207.

Instead, the pressure roller 209 may be driven by another driving source as well. Moreover, a roller fixing device formed of a pair of two rollers including a fixing roller having a heat source and a pressure roller pressed to the fixing roller may be used instead of the belt fixing device.

A surface temperature of the fixing belt 207 is sensed by a temperature sensor (not shown). A temperature control part (not shown) controls the fixing heater 211 on the basis of an output value of the temperature sensor so that the surface temperature of the fixing belt 207 is at a predetermined set temperature.

The sheet P having an unfixed toner image is conveyed through the conveyance path from the transfer roller 112 to the fixing device 200 into the fixing device 200. As shown in FIGS. 1 and 2, the sheet P then passes through the fixing nip part formed by the fixing belt 207 and pressure roller 209, whereby the toner image is melted and fixed on the sheet P by the fixing nip part formed by the fixing belt 207 whose temperature is controlled at a predetermined temperature and the pressure roller 209. Then, the sheet P is sent out to the stacker 115 provided outside the image forming apparatus body.

Note that it is preferable to provide a tension roller 213 for holding tension of the fixing belt 207. In this embodiment, the tension roller 213 is provided outside the fixing belt 207, but the tension roller 213 may be provided inside the fixing belt 207. Although the pressure roller 209 is used as a pressure member, a pressure belt and the like may be used instead of the pressure roller 209.

As shown in FIG. 2, the air nozzle 215 is provided in a vicinity of the exit of the fixing nip part with a fine gap provided from the fixing belt 207 and without contact. Here, only a tip part of the air nozzle 215 is shown for simplicity. Note that, not only the air nozzle 215, but also plural non-contact separation claws (not shown) that are also called separation plates and plural air nozzles (not shown) may be provided in parallel to a longitudinal direction of the pressure roller. Compressed air controlled by a compressed air generating unit and an electromagnetic valve passes through a pipe line of the air nozzle 215 and is ejected once toward the fixing nip part at timing when a leading end of the sheet passes through the fixing nip part. By this flow of compressed air, the leading end of the sheet P is forcibly separated from the fixing belt 207, and the remaining part of the sheet P following the leading end is also naturally peeled off. In the case where the sheets P continuously pass through the fixing nip part, this ejecting operation is performed every time the sheet P passes.

Figure 3:
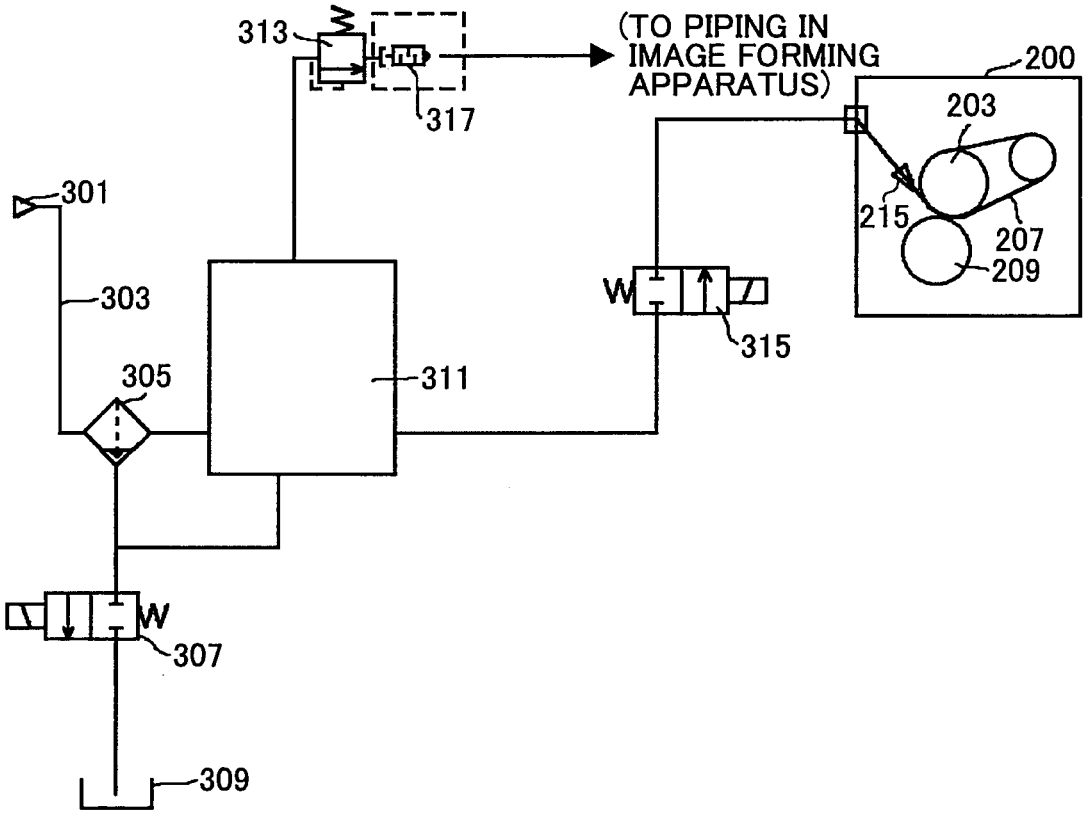
FIG. 3 is a view showing a compressor serving as a compressed air generating unit and a pneumatic piping that controls compressed air, showing first and second embodiments of a pneumatic piping according to the present invention.

FIG. 3 shows a compressor serving as the compressed air generating unit and a pneumatic piping for controlling compressed air, which are characteristic parts of the present invention. By this pneumatic piping, compressed air from the compressor is supplied to the air nozzle 215.

A compressor 301 that generates compressed air is connected to the pneumatic piping. As the compressor 301, for example, a small reciprocating compressor (with output of 100 W) that is provided with a reciprocating engine is used, by which air can be compressed up to about 0.5 MPa. Since this compressor 301 does not have a pressure regulation mechanism, pressure is controlled by a pressure regulation unit provided on a downstream side of the compressor 301.

The compressor 301 has a characteristic in that a flow rate (L/min) of the compressor is decreased as a pressure of the pneumatic piping on a downstream side becomes higher. When the pressure of the pneumatic piping on the downstream side is not an atmospheric pressure (about 0.1 Mpa), the compressor is not started. The compressor 301 has a filter at an air inlet, which prevents foreign matters from being mixed in the compressed air. Compressed air which was made by the compressor 301 and has a high temperature risen by the compression is introduced by a tube 303 that is a cylindrically shaped member into an air filter 305. While passing through the tube 303 having a lower temperature than the compressed air, the compressed air is cooled. By this cooling, a drain such as water formed by condensed vapor in the compressed air is generated.

As the tube 303 used for the pneumatic piping, it is preferable to use a flexible hollow tube formed of polyurethane, nylon, or a fluororesin; or a metal pipe. In order to cool the compressed air at high temperature down to a room temperature while the compressed air passes through the tube or metal pipe, the tube 303 preferably has a long pipe or is preferably formed by using a metal pipe with high heat conductivity. As described above, a drain is generated in the tube 303. Therefore, in order to prevent the drain from flowing upstream to the compressor 301 that is not operating, it is preferable that the tube 303 be piped downwardly from the compressor 301 or a check valve (not shown) having a mechanism to close a valve body by a back pressure of the drain be provided in midstream of the tube 303.

Further, the air filter 305 is provided on a downstream side of the tube 303. The air filter 305 removes foreign matters such as dust existing in the compressed air, and can accumulate the drain generated in the pipe line and discharge the drain out of the pipe line. As an auxiliary device for accumulating the drain, a water separator (not shown) may be used. The water separator does not have a function to remove foreign matters, but has a high performance of a water removal rate at 99%.

An electromagnetic valve (solenoid valve) 307 that is a two-port electromagnetic valve is connected to a drain port of the air filter 305. The electromagnetic valve 307 is a valve opened and closed by an electromagnetic force of an electromagnet. The electromagnetic valve 307 has a function to open and close, and switch an air pressure or an oil pressure to discharge a back pressure and drain in the pipe line. The electromagnetic valve 307 is controlled to open when an operation of the image forming apparatus is stopped, whereby the back pressure in the pipe line is removed and at the same time the drain accumulated in the air filter 305 is discharged. The drain discharged from the electromagnetic valve 307 drops onto an evaporation pan 309 and is naturally evaporated.

An air tank 311 is provided on a downstream side of the air filter 305. The air tank 311 has a function to buffer a compressed air ejection from the compressor 301. By this buffering, a stable compressed air ejection can be realized. In this embodiment, the air tank 311 is manufactured by, for example, welding a steel plate with a thickness of 5 mm, and has a capacity of 1 liter. When the air tank 311 has too much capacity, it takes time to raise a pressure to a set pressure. Therefore, it is preferable that the air tank 311 have a minimum capacity required for stabilizing an ejection pressure of air from the air nozzle 215. The air tank 311 is not required to be provided depending on the specifications and ejection specifications of the air nozzle 215 to be used. The air tank 311 can also be omitted by using the air filter 305 with a large capacity.

The air tank 311 to which a high pressure is applied is preferably formed of a highly rigid metal. The air tank 311 is designed so as to be able to withstand a maximum ultimate pressure or higher of the compressor 301 in consideration of the occurrence of abnormality. By forming the metal air tank 311 having a large area contacting compressed air, the compressed air is easily cooled. Accordingly, vapor that was not formed into drain in an upstream side circuit of the air tank 311 is formed into drain in the air tank 311, attached to a wall surface of the air tank 311, and accumulated on a bottom surface of the air tank 311. The bottom surface of the air tank 311 has a drain port. By an operation of the electromagnetic valve 307 piped to the drain port, a back pressure and the drain are discharged when the image forming apparatus is not operating.

A relief valve 313 serving as a pressure regulation valve is piped to the air tank 311. The pressure regulation valve 313 can be regulated by a screw. The screw is regulated and fixed so that the air tank 311 has a predetermined pressure when the compressor 301 is operated. In this embodiment, the screw is regulated so that the pressure of the air tank 311 becomes about 0.2 Mpa when the compressor 301 operates.

The relief valve used as the pressure regulation valve 313 is opened when an internal pressure of the air tank 311 becomes higher than a specified pressure (relief pressure) to release the pressure outside the air tank 311. On the other hand, when the internal pressure of the air tank 311 becomes lower than the specified pressure (relief pressure), the relief valve is closed to hold a constant pressure. In this embodiment, the specified pressure is about 0.2 Mpa.

By the structure and operations of this relief valve, the relief valve mechanically discharges an excess pressure (air) by a balance between an air pressure and an acting force of a spring. Therefore, there are the following advantages. (1) A complex control to turn ON/OFF driving of the compressor 301 in response to the internal pressure of the air tank is not required. (2) The internal pressure of the air tank can always be maintained constant by simply providing the relief valve 313 in the pneumatic piping. (3) Even when the compressor 301 is driven continuously, the pressure of the air tank 311 does not become high, so that there is no possibility of an explosion or a breakage. In such an apparatus as the present invention with a low flow rate of air, the relief valve is simple and has few pressure variations when ejecting air. Therefore, the relief valve is one constituent member of an optimal pneumatic circuit.

The electromagnetic valve 315 that is a two-port electromagnetic valve is piped on a downstream side of the air tank 311. When the electromagnetic valve 315 is driven by the power turned on, the electromagnetic valve 315 opens the piping, whereby compressed air in the air tank 311 regulated by a fluid control valve of the electromagnetic valve 315 is ejected from the air nozzle 215 connected to the electromagnetic valve 315. Meanwhile, the electromagnetic valve 315 closes the piping when the power is turned off.

When a sheet arrives in front of the fixing device, a leading end of the sheet is sensed by a sheet sensor (not shown) and an ejection start signal is output from a controller (not shown) at a predetermined timing. Before the leading end of the sheet arrives at an ejection part of the air nozzle 215, the electromagnetic valve 315 is driven for 100 ms so that air is ejected for 100 ms per one ejection to separate the leading end of the sheet from the fixing belt 207 and pressure roller 209. Then, the driving of the electromagnetic valve 315 is stopped to finish the ejection. By using the air nozzle in this manner, a jam caused by the leading end of the sheet hitting the separation plate or separation claw can be effectively prevented.

After the sheet has passed through the fixing device 200, the compressor 301 is stopped and the electromagnetic valve 307 is operated, whereby a back pressure is removed from the air filter 305 and air tank 311, and drain is discharged to the evaporation pan 309. By these operations, a pressure of the pneumatic piping is decreased to the atmospheric pressure, and the compressor 301 becomes ready for the next start.

The compressor 301 is driven almost simultaneously with a printing operation, and compressed air is sent into the air tank 311. When the pressure of the air tank 311 is risen higher than the specified pressure (about 0.2 Mpa in this embodiment), an excess pressure (air) is discharged by a mechanical operation of the relief valve 313. Since the compressor 301 is continuously driven at least until the printing operation is finished and a sufficient air flow rate is selected for the continuous printing operations, excess air is continuously discharged from the relief valve 313 and wasted while the compressor 301 is continuously driven. In view of this problem, in the present invention, the excess air from the relief valve 313 is supplied to various parts in the image forming apparatus by piping in the image forming apparatus and used effectively for controlling the image forming apparatus.

Conventionally, the relief valve 313 was provided with a silencer 317 for reducing the noise of compressed air discharged from the valve. According to the present invention, however, by using a sufficiently long tube with a length of about $\phi 10$ mm is used instead of a normal tube with a length of $\phi 6$ mm, the noise caused by a leakage of compressed air is reduced and the silencer 317 becomes unnecessary.

In a first embodiment of a pneumatic piping according to the present invention, the compressor 301 is provided outside the image forming apparatus so that the compressor 301 sucks in air with a lower temperature and lower humidity than those inside the image forming apparatus. In addition, excess air discharged from the relief valve 313 is diverged and guided into areas A1, A2, A3, and A4 (see FIG. 1) in the peripheries of the photosensitive bodies 105Y, 105M, 105C, and 105K of respective colors of the image forming apparatus. Guide paths from a discharge outlet of the relief valve 313, at which a silencer is arranged, to the areas A1 to A4 are coupled by a pneumatic piping that is not shown. Therefore, excess air is guided via the guide paths into each box 130 that covers each of the imaging units from a rear or a front of inside the image forming apparatus, excluding writing light and a transfer part. As the pneumatic piping, a flexible hollow tube formed of polyurethane, nylon, or a fluororesin is preferably used.

By supplying excess air at a low temperature and a low humidity to the areas in the peripheries of the photosensitive bodies 105 by this pneumatic piping, the environments in the peripheries of the photosensitive bodies 105 can be prevented from being at a high temperature and a high humidity, an image deletion and a filming hardly occur, and lives of the photosensitive bodies 105 and their peripheral members can be extended.

In a second embodiment of a pneumatic piping according to the present invention, the compressor 301 is provided in, for example, a heat generating high temperature part in the image forming apparatus, such as in a vicinity of the fixing device or an electrical transmission substrate, and a guide path (not shown) may be piped so that the excess air discharged from the relief valve 313 is guided to the sheet feed tray 120 as an area B (see FIG. 1). This guide path allows air at a relatively high temperature to be blown in a vicinity of the sheet feed tray 120, whereby the sheet P that has absorbed moisture can be dried to stabilize a motion of the sheet, a temperature of the sheet in a low temperature environment before the toner is fixed can be risen. Thus, power that had been required for fixation can be reduced by effectively using the excess heat. Note that the area B may be a conveyance path of the sheet P. The excess air may be blown to the sheet P conveyed in the conveyance path to dry the sheet P.

Figure 4:
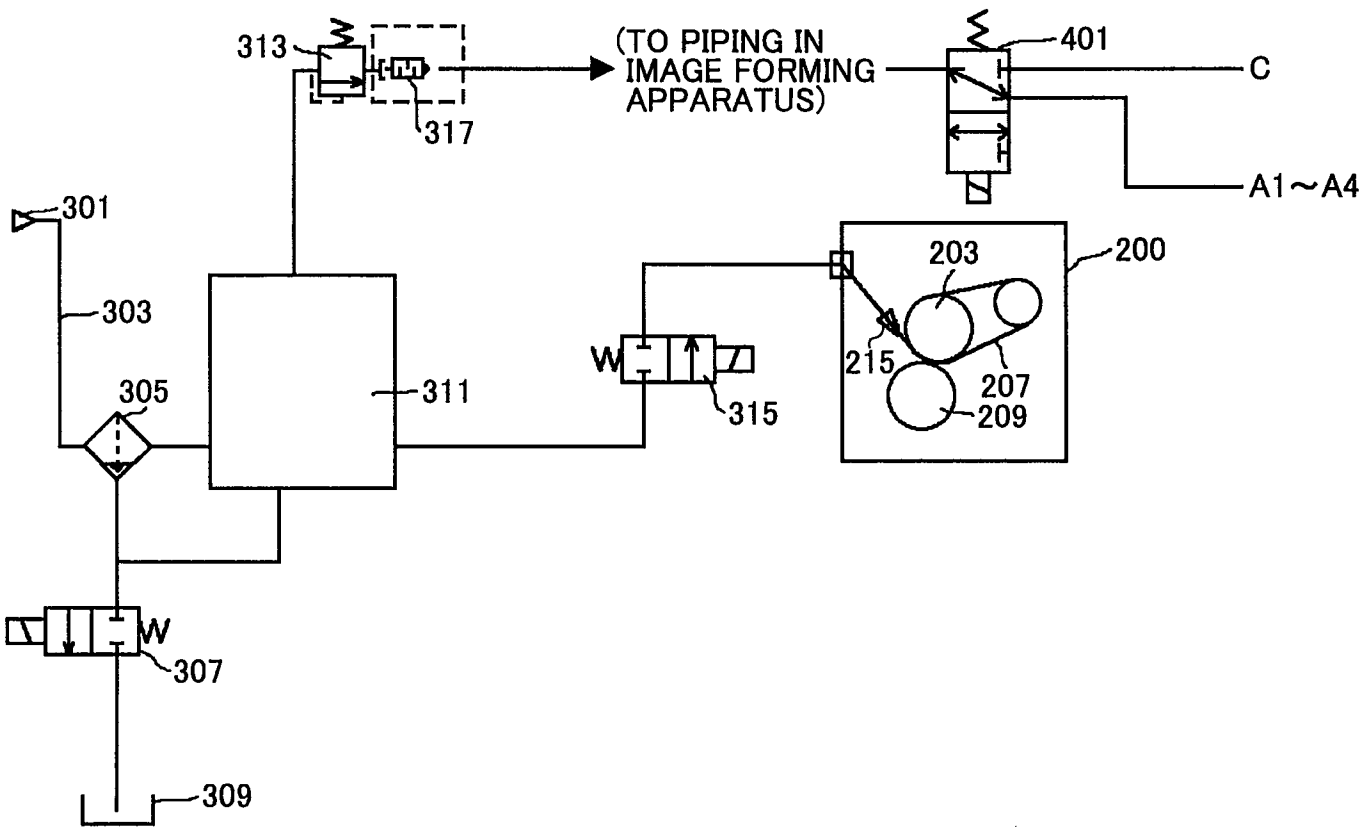
FIG. 4 is a diagram showing a third embodiment of a pneumatic piping according to the present invention.

FIG. 4 shows a third embodiment of a pneumatic piping according to the present invention. Here, the compressor 301 is provided outside the image forming apparatus. In addition, as shown in FIG. 4, an electromagnetic valve 401 that is a three-port electromagnetic valve is provided in the piping in the image forming apparatus, which is connected to the relief valve 313. Not only a guide path extending to the areas A1 to A4, but also a guide path extending to an area C is connected to discharge outlets of the electromagnetic valve 401. The electromagnetic valve 401 can switch these guide paths. The electromagnetic valve 401 can send the excess air to the areas A1 to A4 when a solenoid is demagnetized (not energized), and to the fixing device 200 as the area C (see FIG. 1) by a switching operation of the three-port electromagnetic valve when the solenoid is excited (energized).

By using the electromagnetic valve 401 as the switching unit of this piping and guide paths, there is a following effect. In a high speed enabled printer in which plural fixing temperatures are required to be set depending on the kinds of sheet, when a temperature of a fixing roller is required to be decreased for passing a thin sheet, excess air can be sent to the fixing roller 203 in the area C by driving the compressor 301 in other cases than a printing operation. As a result, fresh air at a sufficiently low temperature as compared to the air inside the fixing device 200 can be blown to a vicinity of the fixing roller 203, so that time required for cooling the fixing roller 203 to a set temperature and waiting time can be drastically reduced.

Figure 5:
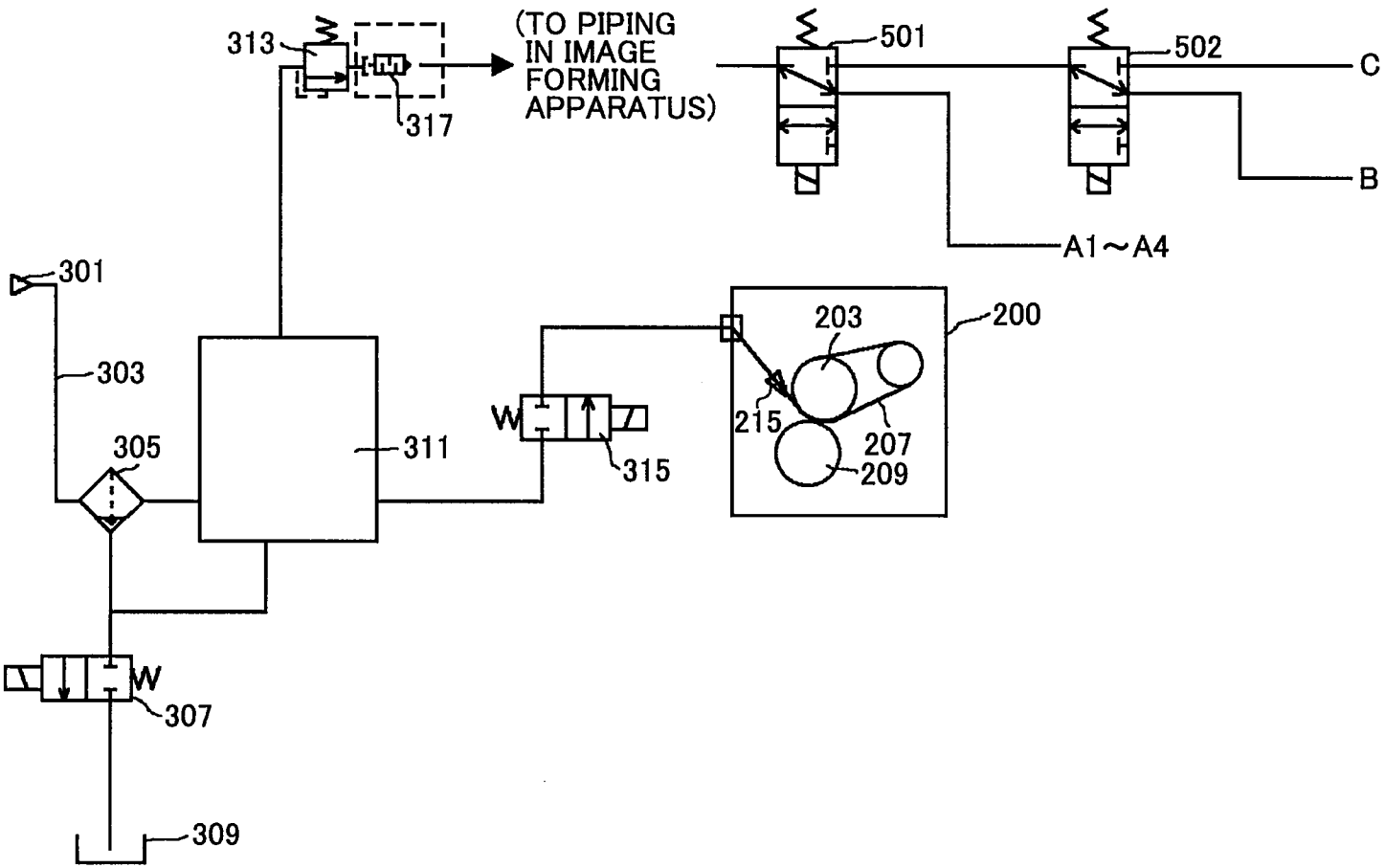
FIG. 5 is a diagram showing a fourth embodiment of a pneumatic piping according to the present invention.

FIG. 5 shows a fourth embodiment of a pneumatic piping according to the present invention. Here, two electromagnetic valves 501 and 502 which are three-port electromagnetic valves are used in combination. In addition, two temperature sensing units (not shown) are provided in the image forming apparatus and in a vicinity of the compressor 301 provided outside the image forming apparatus. The two electromagnetic valves 501 and 502 are switched by comparing temperatures sensed by the two temperature sensing units. When the temperature in the vicinity of the compressor 301 is lower than the temperature in the image forming apparatus, the excess air can be supplied via a guide path connected to the electromagnetic valve 501 to the areas A1 to A4, or via a guide path connected to the electromagnetic valve 502 to the fixing device 200 of the area C which is a high temperature part, by switching the electromagnetic valves 501 and 502. When the temperature in the vicinity of the compressor 301 is higher than the temperature in the image forming apparatus, the excess air can be supplied via a guide path connected to the electromagnetic valve 502 to the sheet feed tray 120 of the area B which is a low temperature part, by switching the electromagnetic valves 501 and 502. In this manner, a destination of the excess air supply can be changed in response to the temperature in the vicinity of the compressor, and the excess air can be effectively utilized by selecting the guide path.

Note that, in the above-described embodiments, the excess air may be ejected onto a sensing surface of plural non-contact sensors provided in the image forming apparatus, such as the sensor for sensing the temperature of the fixing member and the sensor for sensing the presence or absence of a sheet in a conveyance path, in order to clean the sensing surface.

Effects obtained by using the relief valve are as follows: a complex control for turning ON/OFF driving of the compressor in response to an internal pressure of an air tank is not necessary, the internal pressure of the air tank can be always maintained constant by providing the relief valve in the pneumatic piping, and there is no possibility of an explosion or a breakage of the air tank because a pressure in the air tank does not becomes a high pressure even when the compressor is continuously driven. In the present invention, while holding these effects obtained by using the relief valve, excess air discharged from the relief valve that has conventionally been wasted can be guided to a part in the image forming apparatus and effectively reused. As a result, environments of the photosensitive bodies and their peripheral members can be prevented from becoming a high temperature and a high humidity, whereby lives of the photosensitive bodies and their peripheral members can be extended. Moreover, by drying a sheet that absorbed moisture, a motion of the sheet can be stabilized. Further, the temperature of a sheet before toner is fixed in a low temperature environment can be risen, so that a fixing temperature of the sheet can be more efficiently controlled. Furthermore, by ejecting low temperature air to the fixing member, waiting time for cooling the fixing member can be reduced.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teachings herein set forth.

This patent application is based on Japanese Priority Patent Application No. 2010-040102 filed on Feb. 25, 2010, the entire contents of which are hereby incorporated herein by reference.

What is claimed is:

1. An image forming apparatus comprising:

an image carrier;

a developing device configured to form a toner image on the image carrier;

a compressed air generating unit configured to generate compressed air;

an air nozzle configured to eject the compressed air;

a fixing device configured to fix the toner image on a sheet, the sheet being separated from the fixing device by the compressed air ejected from the air nozzle to the sheet;

a pressure regulation unit provided between the compressed air generating unit and the air nozzle; and a guide path connected to the pressure regulation unit and configured to guide excess air generated by a pressure regulation of the pressure regulation unit to at least one part in the image forming apparatus.

2. The image forming apparatus as claimed in claim 1, wherein the compressed air generating unit is provided outside the image forming apparatus, and the guide path is lead to a vicinity of the image carrier and the developing device.

3. The image forming apparatus as claimed in claim 1, wherein the compressed air generating unit is provided in a vicinity of the fixing device or an electrical transmission substrate in the image forming apparatus, and the guide path is lead to a sheet stacking part in which the sheet is stacked or a sheet conveyance path through which the sheet is conveyed.

4. The image forming apparatus as claimed in claim 1, further comprising at least one switching unit connected to the pressure regulation unit; a first guide path lead to a vicinity of the image carrier and the developing device and connected to the switching unit; and a second guide path lead to a vicinity of the fixing device and connected to the switching unit, wherein the compressed air generating unit is provided outside the image forming apparatus, and the switching unit switches between the first guide path and the second guide path.

5. The image forming apparatus as claimed in claim 4, wherein the switching unit is a three-port electromagnetic valve.

6. The image forming apparatus as claimed in claim 1, further comprising a first switching unit connected to the pressure regulation unit; a second switching unit connected to the first switching unit; a first guide path lead to a vicinity of the image carrier and the developing device and connected to the first switching unit; a second guide path lead to a vicinity of the fixing device and connected to the second switching unit; and a third guide path lead to a sheet stacking part in which the sheet is stacked or to a sheet conveyance path through which the sheet is conveyed and connected to the second switching unit, wherein the compressed air generating unit is provided outside the image forming apparatus, and the first guide path, the second guide path, and the third guide path are switched by the first switching unit and the second switching unit.

7. The image forming apparatus as claimed in claim 6, further comprising at least two temperature sensing units that are provided in the image forming apparatus and in a vicinity of the compressed air generating unit, wherein the first guide path, the second guide path, and the third guide path are switched on the basis of temperatures sensed by the temperature sensing units.

8. The image forming apparatus as claimed in claim 7, wherein the first and second switching units are three-port electromagnetic valves.

9. The image forming apparatus as claimed in claim 6, wherein the first and second switching units are three-port electromagnetic valves.

* * * * *